US006318730B1

(12) United States Patent
Neely

(10) Patent No.: US 6,318,730 B1
(45) **Date of Patent: *Nov. 20, 2001**

(54) TUFTING MACHINE PUSH ROD HOUSING GLAND SEAL ASSEMBLY

(75) Inventor: Marshall Allen Neely, Soddy Daisy, TN (US)

(73) Assignee: Card-Monroe Corp., Chattanooga, TN (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/054,190

(22) Filed: Apr. 2, 1998

(51) Int. Cl.[7] ..... F16J 15/18; D05C 15/08

(52) U.S. Cl. ..... 277/524; 277/525; 277/530; 112/80.01

(58) Field of Search ..... 277/524, 525, 277/520, 529, 530; 112/80.01; 184/6.15, 6.18

(56) References Cited

U.S. PATENT DOCUMENTS

| | | | | |
|---|---|---|---|---|
| 2,726,882 | * | 12/1955 | Ryant | 277/520 |
| 2,845,286 | * | 7/1958 | Case et al. | 277/529 |
| 2,857,213 | * | 10/1958 | Meier | 277/529 |
| 3,577,833 | * | 5/1971 | Skelton | 92/168 |
| 3,633,523 | | 1/1972 | Card . | |
| 3,655,204 | * | 4/1972 | Sievenpiper | 277/520 |
| 3,778,881 | * | 12/1973 | Knapp | 29/401 |
| 3,827,700 | * | 8/1974 | Kaller | 277/529 |
| 4,048,930 | | 9/1977 | Card . | |
| 4,060,023 | * | 11/1977 | Vegella | 92/168 |

(List continued on next page.)

OTHER PUBLICATIONS

Parker Hannifin Corporation, "Gland Seal Kits for Hydraulic Cylinders," Mar. 1995.
Parker Hannifin Corporation, "Sealing Solutions Guide," Catalog 500A USA, Aug. 1997.
Parker Hannifin Corporation, Motion & Control Brochure, Bulletin 0101–B1, Feb. 1996.
Parker Hannifin Corporation, Directory of Products & Services, Bulletin DPS98 USA 1998.
Parker Hannifin Corporation, Sealing Solutions Guide, Catalog 5000 USA.

*Primary Examiner*—Anthony Knight
*Assistant Examiner*—Alison K. Pickard
(74) *Attorney, Agent, or Firm*—Womble Carlyle Sandridge & Rice, PLLC

(57) ABSTRACT

An improved tufting machine push rod housing gland seal assembly for use with a tufting machine is disclosed. The gland seal assembly of the invention includes an elongate carrier formed by a longitudinal axis, having a first end and a spaced second end, constructed for being received within a gland seal receiving cavity defined within a push rod housing. A concentric throughbore is defined within the carrier about the longitudinal axis. A first continuous annular groove is defined in a side wall of the bore, and an axially spaced second continuous annular groove is also defined in the side wall of the bore. The two grooves together define therebetween a continuous annular bearing surface for supporting and guiding the push rod as it is reciprocated through the gland seal assembly and along the axis, thus minimizing the impact of push rod flexure or oscillation on the gland seal assembly, and the push rod housing. A continuous annular push rod lip seal is seated within the first groove, and a continuous annular push rod wiper seal is seated within the second groove. A continuous annular exterior shoulder is defined along the first end of the carrier, about which a continuous O-ring is passed, such that as the gland seal assembly is placed within the gland seal receiving cavity of the push rod housing and fastened to the push rod housing, the gland seal assembly becomes sealed on an internal shoulder formed as a part of the push rod housing.

16 Claims, 4 Drawing Sheets

U.S. PATENT DOCUMENTS

| | | | | |
|---|---|---|---|---|
| 4,366,761 | | 1/1983 | Card . | |
| 4,419,944 | | 12/1983 | Passons et al. . | |
| 4,478,423 | * | 10/1984 | Hjelsand et al. | 277/529 |
| 4,545,312 | * | 10/1985 | Ingram | 112/256 |
| 4,625,978 | | 12/1986 | Jelinek . | |
| 4,717,792 | | 1/1988 | Sterritt et al. . | |
| 4,858,936 | * | 8/1989 | Adams | 277/530 |
| 5,005,877 | | 4/1991 | Hayman . | |
| 5,044,401 | | 9/1991 | Giesler et al. . | |
| 5,169,160 | * | 12/1992 | Gaskill et al. . | |
| 5,499,588 | | 3/1996 | Card et al. . | |
| 5,577,737 | * | 11/1996 | Lacy | 277/530 |
| 5,634,674 | | 6/1997 | Fuser . | |
| 5,642,892 | | 7/1997 | Burgess . | |

* cited by examiner

TUFTING MACHINE PUSH ROD HOUSING GLAND SEAL ASSEMBLY

FIELD OF THE INVENTION

The invention relates in general to tufting machines. More particularly, the invention relates to an improved tufting machine push rod housing gland seal assembly for use with a tufting machine push rod housing to seal the push rod within the push rod housing so that oil and other fluids do not leak therefrom during operation of the tufting machine.

BACKGROUND OF THE INVENTION

The use of tufting machines to create tufted articles, for example carpeting, is well known. The known types of tufting machines typically include an elongate framework having a base section, and a head seated on the base. An aligned series of needles, each of which is supplied with a yarn, is reciprocably driven through a backing material passed through a tufting zone defined on the framework beneath the needles to produce the tufted articles. As known, the needles will be mounted on an elongate needle bar extending the width of the tufted article, i.e., in the widthwise direction of the tufting machine. The needle bar in turn is reciprocably driven by a series of spaced push rods which are supported for reciprocating motion on the head of the tufting machine. Each push rod will be provided with a push rod housing and seal assembly. A rotatably driven tufting machine main drive shaft is housed within the head and drives the push rods. The main drive shaft is exposed to a recirculating oil bath for the purposes of both cooling and lubricating the tufting machine main drive shaft, as well as the push rods.

As the tufted article is produced, the backing material is transversely passed through the tufting zone and beneath the needle bar such that for each stitch cycle a row of tufts is formed in the backing material. In order to sew the next successive row of tufts, the backing material is advanced with respect to, and in timed relationship with the reciprocation of, the needle bar. However, due to the high speed at which modem tufting machines operate, oftentimes the needles are engaged in the backing material as it begins to advance, which thus tends to pull the needle bar to which the needles are mounted, and in turn flex or oscillate the push rods, in the direction of the movement of the backing material travel through the tufting zone. This flexure of the needle bar and push rods is typically not enough to substantially damage the machine, however, it does result in increased wear of the known types of seal assemblies used in the push rod housing and seal assemblies supporting the individual push rods for reciprocation. As a result of this oscillation and/or wear of the seal assembly, the cooling oil contained within the head is allowed to be passed along the exterior surface of the push rod through the seal assembly, with the result that the cooling oil then splashes or drips onto the backing material as it passes through the tufting zone with the result that the tufted article will become stained with the oil, necessitating the scrapping of that portion of the now tufted article, all of which reduces machine and operating efficiencies, as well as leading to increased maintenance requirements for replacing the seal assemblies to prevent this type of oil leakage.

A known type of push rod housing and seal assembly is illustrated in FIG. 1. A push rod housing 5 is shown having a first end 6 and a spaced second end 7. The push rod housing is formed about an axis A, and has an elongate continuous throughbore 9 defined therein concentrically about the axis. In known fashion, a tubular bushing 10 is received within the bore, and a tubular top guide or bushing 11 is received in the bore at the top end 6 of the push rod housing, both of these bushings being provided for guiding, i.e. serving as bearing surfaces, for the circumferential surface of the push rod (not illustrated) which reciprocates therethrough. The housing is provided with an annular mounting flange 13 having a radially spaced series of openings 13' defined therein, such that a separate fastener 13" can be passed therethrough for fastening the push rod housing to the base portion (not illustrated) of the head (not illustrated) of the tufting machine (not illustrated), in known fashion. A seal gasket 14 is provided for sealing the mounting flange on the base portion of the head in the effort to prevent oil leakage therethrough.

Still referring to FIG. 1, a known type of seal assembly 15 is illustrated for use with push rod housing 5. The seal assembly includes an annular felt washer 17 through which the push rod is passed. The felt washer will be soaked with oil as the washer passes along the exterior surface of the push rod as the push rod reciprocates through the push rod housing, and serves to lubricate the push rod and to prevent the passage of oil and out of the housing and onto the backing material. The seal assembly is also provided with an annular seal gasket 18, an annular push rod wiper seal 19, and a bottom retainer plate 21 for being threadably fastened to the second end 7 of push rod housing 5. So constructed, therefore, seal gasket 14, felt washer 17, and seal gasket 18 are provided for "sealing" the push rod housing, and the push rod, on the head of the tufting machine to prevent the passage of oil therethrough and onto the backing material.

Of note, however, the known types of assemblies do not include any means for bearing, i. e. guiding or supporting, the push rod as it extends therethrough, particularly during its period of flexure during the tufting operation. As a result of this, therefore, the flexure or whip in the push rod tends to wear against the felt washer 17, as well as the push rod wiper seal 19 through a constant oscillating motion, such that not only do these two parts wear, but that oil is allowed to pass along the push rod by hydroplaning underneath or past the felt washer and wiper seal, such that it continues to extend downward along the push rod, and will then splash or drip onto the backing material during tufting operations.

Examples of the known type of tufting machine push rod housing and seal assemblies are shown in U.S. Pat. No. 3,633,523 to Card; U.S. Pat. No. 4,048,930 to Card; U.S. Pat. No. 4,366,761 to Card; U.S. Pat. No. 4,419,944 to Passons, et aL; and U.S. Pat. No. 5,499,588 to Card, et al. In each of these patents, the known type of push rod housing and seal assembly, described above, is used for supporting the push rod of the respective tufting machines for reciprocation, and for sealing the push rod and push rod housing on the head of the tufting machine in the effort to prevent the passage of cooling oil therethrough and onto the backing material as it advances through the tufting zone during the tufting of the article on the machine.

What is needed, therefore, but seemingly unavailable in the art is an improved tufting machine push rod housing gland seal assembly, as well as an improved gland seal assembly that can be used with currently known push rod housings, which will prevent the leakage of oil from the head of the tufting machine onto the backing material as it advances through the tufting zone. What is also needed is such an improved push rod housing gland seal assembly which will have a bearing surface for that portion of the length of the push rod extending therethrough to prevent the flexure or whip of the push rod from unduly wearing the seals of the assembly, for example the lip seals or wiper seals, which seal the push rod on the housing, such that lubricating oil from the head of the tufting machine is not allowed to pass therethrough and onto the backing material of the tufted article. Moreover, there is a need for such an improved push rod housing and gland seal assembly which can be easily fit, or retrofit to new or existing machines quickly and economically, and which will improve the operating efficiencies of tufting machines by reducing, if not eliminating, the leakage of oil from the head of the tufting machine onto the backing material.

SUMMARY OF THE INVENTION

The push rod housing and gland seal assembly of this invention, and more particularly the new gland seal assembly of the invention, greatly reduces, if not eliminates entirely, the prospects of lubricating oil leaking from the head of the tufting machine through the push rod housing gland seal assembly, and being splashed or dripped onto the backing material of the tufted article. This, therefore, results in improved operating efficiencies, reduced maintenance requirements, and overcomes an age old problem of oil leakage from the heads of tufting machines onto the tufted articles.

The improved gland seal assembly of the invention thus comprises an elongate carrier formed concentrically about a longitudinal axis, the carrier having a first end and a spaced second end. An annular mounting flange is formed as a part of the carrier intermediate the first and second ends, and extends outwardly so that the carrier can be mounted to one of the known types of push rod housings. A throughbore is defined within the carrier concentrically about the axis, and defines an internal side wall. A first continuous annular groove is defined within the side wall concentrically about the axis, and a second axially spaced continuous annular groove is also defined within the side wall, concentrically about the axis. The spacing between these first and second grooves in the side wall of the carrier bore defines an annular bearing surface therebetween, formed concentrically about the axis for guiding and supporting the push rod as it is reciprocated through the gland seal assembly.

A continuous annular push rod lip seal, having three raised lips for greater sealing efficiency, is seated within the first groove of the carrier for sealing the push rod within the push rod housing, and a continuous annular push rod wiper seal, typically a "U"-shaped wiper seal, is seated within the second groove of the carrier for preventing dirt or debris from entering the gland seal assembly on the backstroke portion of the tufting machine operation. An external shoulder is defined at the first end of the carrier, and a continuous O-ring is seated on the shoulder such that as the carrier is received within a gland seal receiving cavity defined within a push rod housing, the O-ring is compressed against an internal shoulder within the push rod housing so that the O-ring tends to completely seal the carrier on the push rod housing. The gland seal assembly, as constructed above, provides not only a seal, but also a bearing surface for the push rod as it extends therethrough for reducing the effects of push rod flexure on the seal assembly. The improved lip seal and wiper seal configuration decrease the passage of lubricating oil from the head of the tufting machine through the push rod housing and onto the backing material, which greatly reduces, if not eliminates entirely, the known oil leak problems of the known seal assemblies.

In a preferred embodiment, the carrier is machined as a one-piece structure. In an alternate embodiment, however, the carrier can be formed of a first carrier piece having an internally threaded bore defined therein, with an externally threaded elongate cartridge sized and shaped to be threadably received within the bore of the carrier. The cartridge is formed concentrically about the axis of the push rod, having a first end and a spaced second end. A continuous annular bore is defined within the cartridge, and extends therethrough, defining a side wall. As with the first embodiment of the gland seal assembly, a first continuous annular groove is defined within the side wall, and an axially spaced second continuous annular groove is also defined in the side wall. These two annular grooves, together, define the bearing surface within the cartridge therebetween. A continuous annular lip seal is contained within the first groove, and a continuous annular wiper seal is contained in the second groove.

In both embodiments of the invention, the second end of the carrier, or the cartridge, respectively, is counter-bored such that any push rod flexure or whip that occurs tends not to move the carrier or cartridge, respectively, nor unduly wear the seals thereof for the purpose of not allowing oil to leak between the push rod housing and the gland seal assembly, nor through the gland seal assembly, and to seal the push rod and the push rod housing on the head of the tufting machine in fashion heretofore unknown in the art, with results heretofore unattainable in the art.

It is, therefore, an object of the invention to provide an improved tufting machine push rod housing gland seal assembly which will provide a bearing surface for the push rod reciprocated therethrough, minimizing the effects of push rod flexure or whip, as well as providing an improved type of gland seal assembly for greatly minimizing, if not eliminating, the prospect of tufting machine lubricating oil passing from the head of the tufting machine along the push rod and onto the backing material of the tufted article. These, as well as the other objects and features of the present invention, will become apparent upon review of the attached drawings, as well as in the detailed description of the invention, below.

DETAILED DESCRIPTION OF THE PREFERRED EMBODIMENTS

Figure 2A:
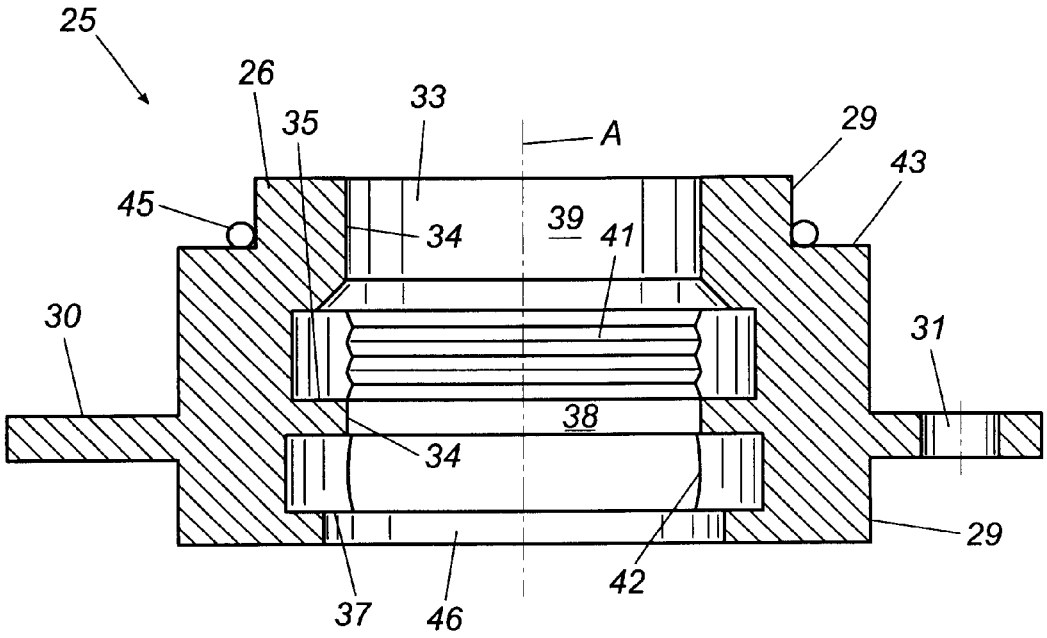
FIG. 2A is a cross-sectioned elevational view of a first embodiment of the improved gland seal assembly of this invention.
Figure 3A:
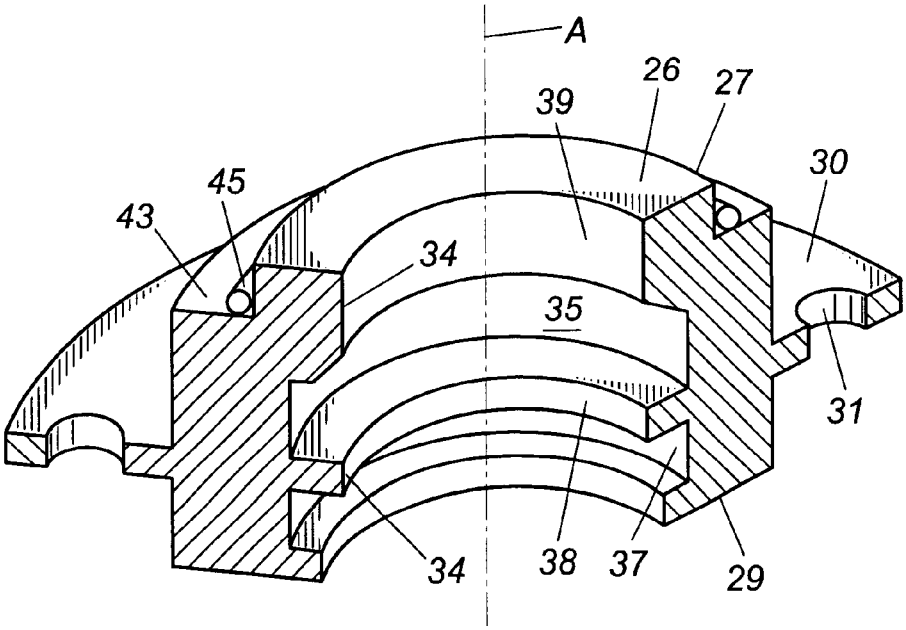
FIG. 3A is a partial perspective cut-away view of the gland seal assembly carrier of FIG. 2A.

Referring now in detail to the drawings, in which like reference characters and numerals indicate like parts throughout the several views, numeral 25 of FIG. 2A illustrates a first embodiment of the improved tufting machine push rod housing gland seal assembly of this invention. The gland seal assembly 25 is comprised of an elongate carrier 26 (FIGS. 2A, 3A) having a first end 27 and a spaced second end 29, the carrier being formed concentrically about a longitudinal axis, denoted by the reference character "A". A continuous annular flange 30 is formed on the exterior periphery of the carrier intermediate the first and second ends thereof, and extends outwardly and away from the carrier. The flange 30 has a radially spaced series of openings 31 defined therein, as illustrated in FIGS. 2A and 3A, and through which a fastener (not illustrated) may be passed for threadably securing the gland seal assembly to the bottom of a push rod housing, such as push rod housing 82 shown in FIG. 4 and described in greater detail below.

A throughbore 33 is defined in the carrier concentrically about axis A. Bore 33 thus defines a continuous internal side wall 34 within carrier 26. A first continuous and concentric annular groove 35 is defined within the side wall of the bore. A second axially spaced continuous and concentric annular groove 37 is also defined in the side wall 34 of the bore 33. The first and second grooves 35, 37 thus define an annular continuous and concentric bearing surface 38 formed by and between the two grooves 35, 37 in the side wall of the bore. Spaced axially from the bearing surface 38, toward the first end 27 of the carrier, is an annular neck 39, also defined by the side wall, which forms a concentric second bearing surface so that the push rod (not illustrated) that will be passed through the gland seal assembly is rigidly supported against flexure or bending at the end of the push rod housing 82 (FIG. 4) as the push rod reciprocates through the gland seal assembly. Thus, rather than allowing the portion, or end, of the push rod projecting through the push rod housing to freely flex or oscillate based on the transverse movement of the backing material and the engagement of the needles therein, the push rod is supported fully along its length within the push rod housing and the gland seal assembly such that a more uniform and consistent sealing of the push rod can take place.

This is effected by a continuous annular push rod lip seal 41 which is seated within first groove 35, and a continuous annular push rod wiper seal, typically a "U"-shaped seal 42, of known construction, seated within second groove 37. Push rod lip seal 41 as shown in FIGS. 2A and 4 has three axially spaced continuous raised lips which form the sealing surface engaged on the exterior periphery of the push rod (not illustrated) as it passes therethrough, to thus ensure that any oil which may otherwise seep down along and through the push rod housing and/or is carried on the push rod is kept from passing through the lip seal toward the rod wiper seal to lessen the likelihood that the oil will leak therethrough to possibly splash or drip onto the backing material as it passes transversely underneath the needle bar during tufting operations.

Push rod lip seal 41 and push rod wiper seal 42 are conventional seals, and may comprise that family of seals manufactured by the Parker Seal Group of Parker Hannifin Corporation of Cleveland, OH. Both lip seal 41 and wiper seal 42, however, will be dynamic seals as opposed to static seals, and will be made of the known types of resilient, flexible, rubber, either natural or synthetic, and preferably plastic seals adapted for use in sealing high speed reciprocating shafts. As such, it is anticipated that the seals could be made of any of the many plastics of which modern seals are made, to include nitrile, hydrogenated nitrile, neoprene, polyacrylate, fluorocarbon, perfluoroelastomer, ethylene propylene, butyl, silicon, fluorosilicon, polyurethane, polytetrafluoroethylene, polyetherketone, nylon, and other specialty elastomers intended for use in seals. Reference is made to the Parker Seals Sealing Solutions Guide, Catalog 5000A USA, copyright 1997, which discloses these seals in greater detail.

Figure 4:
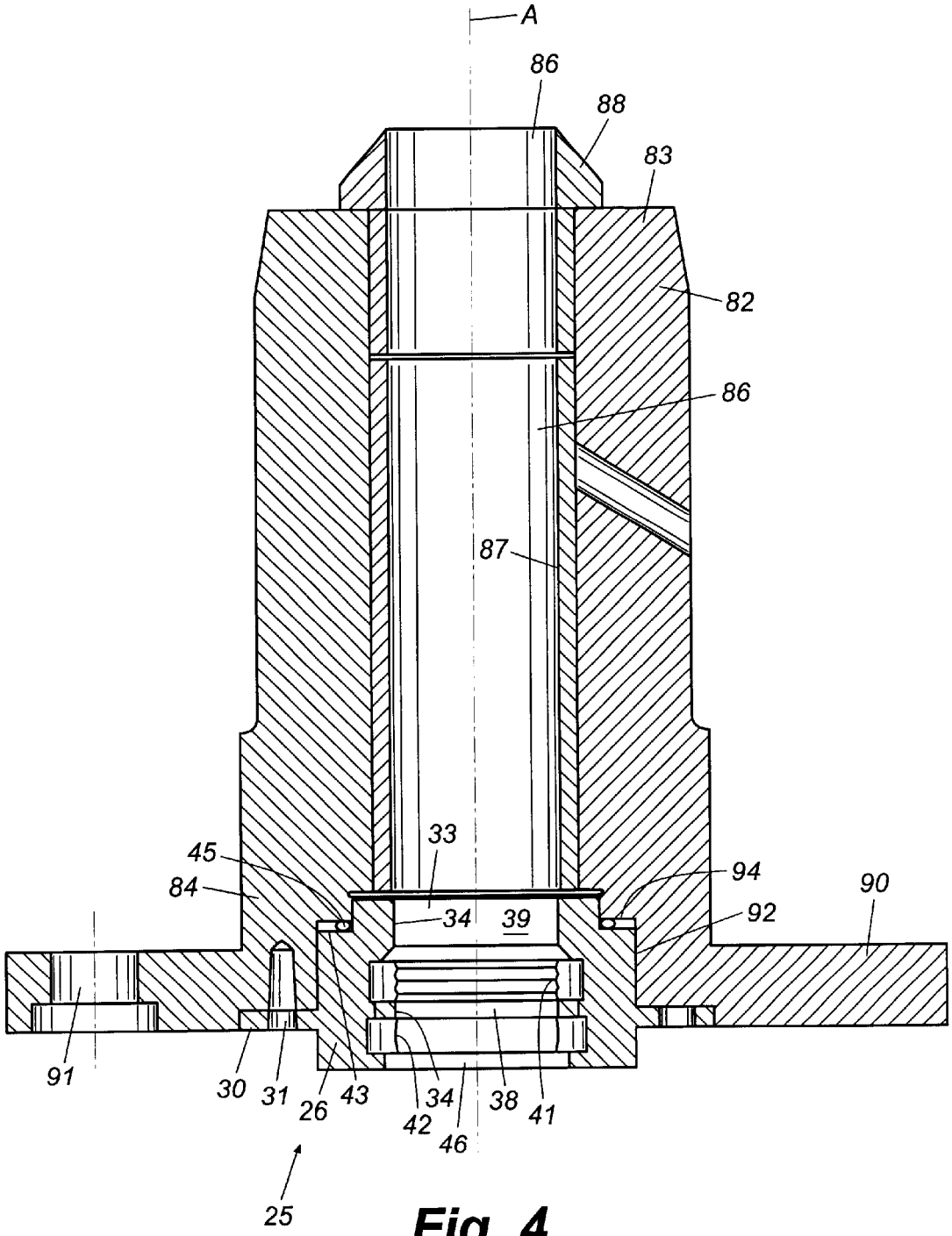
FIG. 4 is a cross-sectioned elevational view of the tufting machine push rod housing gland seal assembly illustrated in FIGS. 2A and 3A received within a gland seal receiving cavity of a push rod housing.

Referring to FIGS. 2A and 3A, the first end 27 of carrier 26 is provided with an exterior shoulder 43, defined therein, and about which a continuous flexible, resilient O-ring, for example a neoprene O-ring 45, is passed, such that when the gland seal assembly 25 is fastened to a push rod housing, such as push rod housing 82 in FIG. 4, the O-ring 45 will seal the gland seal assembly on the push rod housing to prevent the leakage of oil from the housing. A counter-bore 46 is defined within the second end 29 of carrier 26, which will be the end facing outwardly and away from the gland seal assembly and the push rod housing, such that any flexure of the push rod resulting from the movement of the backing material will not be physically directed through the gland seal, and will tend not to oscillate or vibrate any portion of the gland seal assembly.

Figure 1:
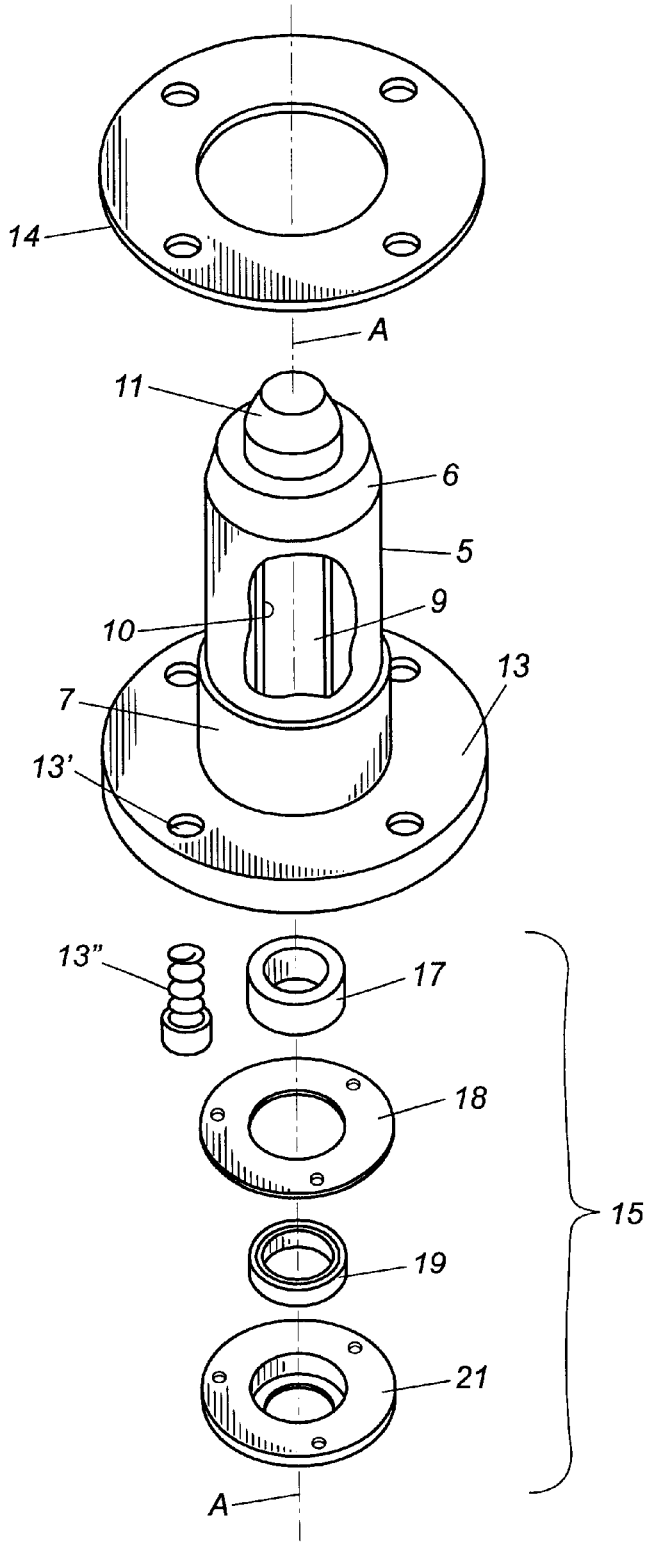
(Prior Art) Fig. 1
FIG. 1 is an exploded perspective view of a known type of tufting machine push rod housing gland seal assembly.

Carrier 26 of gland seal assembly 25 shown in FIGS. 2A and 3A is preferably machined from a solid piece of bar stock, for example steel, or may be machined of a brass or bronze bearing material similar, if not identical, to the material used to fabricate bushings 10 and 11 of the prior art push rod housing in FIG. 1, as well as bushings 87 and 88 of push rod housing 82 illustrated in FIG. 4.

Figure 2B:
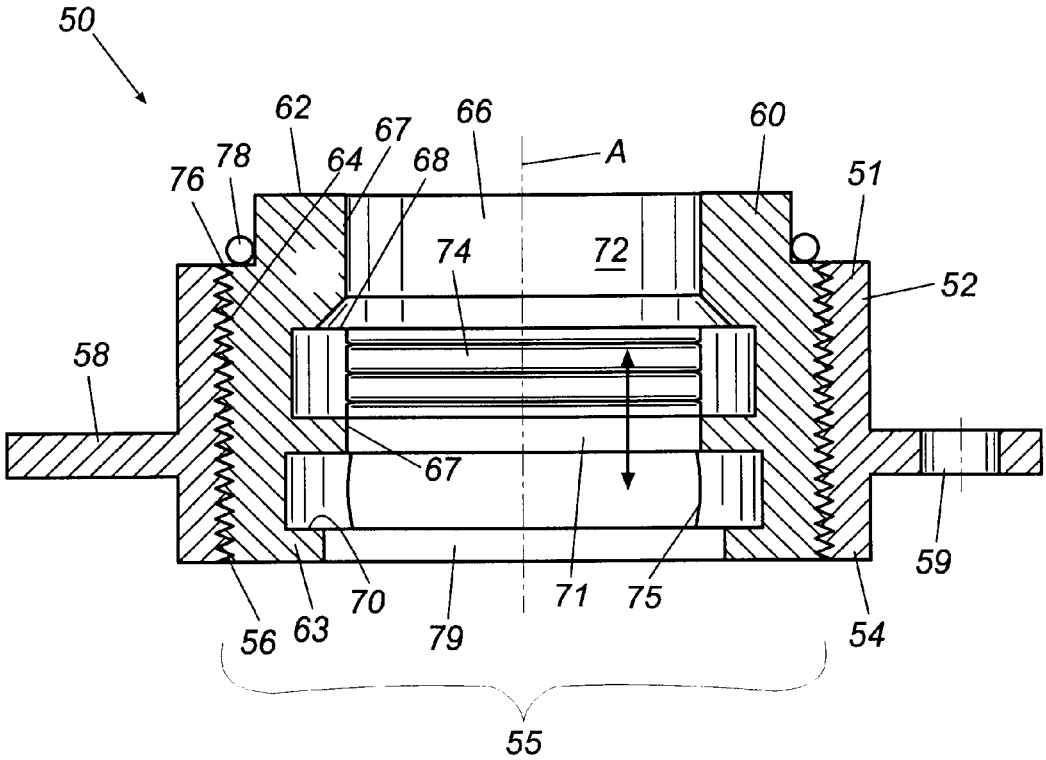
FIG. 2B is a cross-sectioned elevational view of a second embodiment of the improved gland seal assembly of this invention.
Figure 3B:
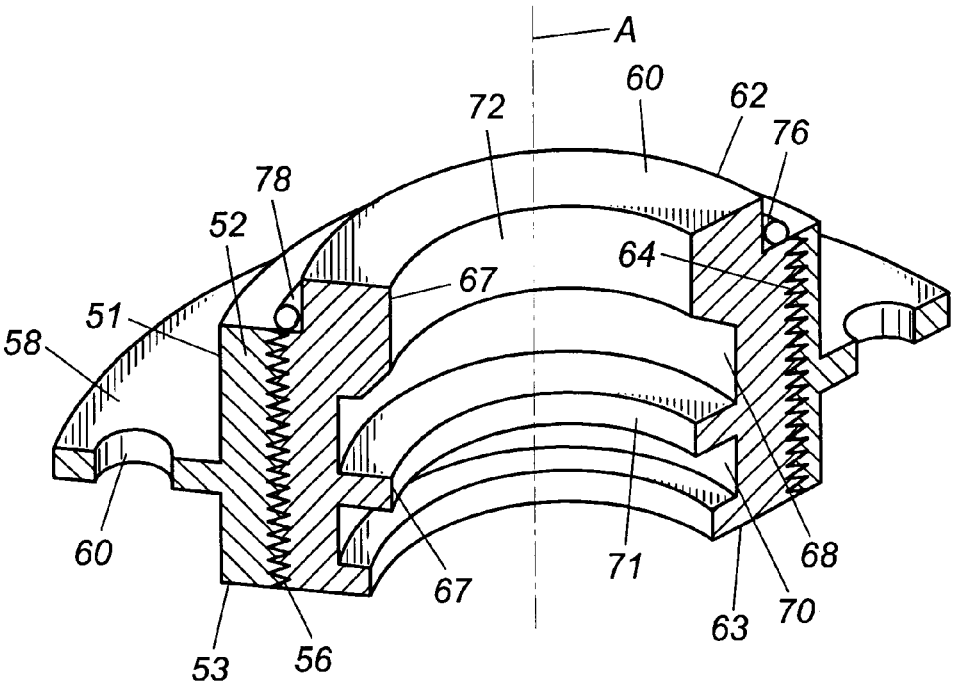
FIG. 3B is a partial perspective cut-away view of the gland seal assembly carrier and cartridge of FIG. 3B.

A second embodiment of gland seal assembly 50 is illustrated in FIGS. 2B and 3B. Unlike the gland seal assembly 25 of FIGS. 2A and 3A, gland seal assembly 50 is comprised of two complementary pieces which are sized and shaped to cooperate with one another to form the gland seal assembly. As such, gland seal assembly 50 includes an elongated carrier portion 51 formed concentrically about axis A, having a first end 52 and a spaced second end 54. Once again, a continuous annular bore 55 is defined concentrically about axis A and extends through carrier 51, this bore, however, having a diameter greater than the diameter of bore 33 within carrier 26, and a diameter greater than bore 66 defined within cartridge 60, described below. A continuous helical internal thread 56 is defined within and along the surface of bore 55, extending from the first end to the second end of the carrier. A continuous annular mounting flange 58 is formed as a part of carrier 51, intermediate its first and second ends, and extends outwardly and away from the carrier for mounting the carrier, and in turn the gland seal assembly, to the second end of a push rod housing, as illustrated generally in FIG. 4. The mounting flange 58 thus has a radially spaced series of openings 59 defined therein, shown in FIGS. 2B and 3B, for receiving one of a number of fasteners (not illustrated) therein and passed therethrough for threadedly fastening gland seal assembly 50 to a push rod housing.

As shown in FIGS. 2B and 3B, this embodiment of gland seal assembly 50 includes an elongate cartridge 60 formed about axis A, having a first end 62 and a spaced second end 63. The cartridge has a continuous helical external thread 64 defined thereon for threaded engagement with internal thread 56 of carrier 51. So constructed, the cartridge is selectively positionable along the length of axis A within carrier 51. Moreover, although not illustrated in FIGS. 2B and 3B, it is anticipated that the second end 63 of cartridge 60 may be provided with a series of regularly spaced slots or indentations defined therein for receiving the known types of tools used to rotate the cartridge within the thread 56 of carrier 51, for accomplishing the selective positioning of the cartridge within the carrier of the gland seal assembly. This thus provides a greater degree of flexibility in sealing, and in supporting the end of the push rod (not illustrated) passed through the gland seal assembly than heretofore known in the art.

Cartridge 60 has a continuous annular bore 66 defined therein concentrically about axis A, extending from the first end to the second end of the cartridge. Bore 66 defines a continuous annular side wall 67 in which a first continuous and concentric annular groove 68 is defined, and in which an axially spaced continuous and concentric annular second groove 70 is defined, in much the same fashion as are grooves 35 and 37 of gland seal assembly 25. Accordingly, grooves 68 and 70 define a continuous and concentric annular bearing surface 71 therebetween. Side wall 67 of bore 66 also defines a concentric annular neck 72 at the first end 62 of cartridge 60, spaced axially from bearing surface 71, and which also acts as a bearing surface for supporting the push rod (not illustrated) as it is reciprocated therethrough, and more particularly to resist the bending moment imparted by the flexure of the push rod as the needles remain engaged in the backing material as it advances transversely through the tufting zone of the tufting machine.

A continuous annular push rod lip seal 74 is seated within first groove 68, and a continuous annular push rod wiper seal 75, a U-shaped wiper seal, is seated within second groove 70. Push rod lip seal 74 is identical to push rod lip seal 41, and push rod wiper seal 75 is identical to push rod wiper seal 42, and again these two seals 74, 75 may comprise any one of those seals disclosed in the Parker Seals Group Seals Solution Guide, identified above.

Gland seal assembly 50 includes a continuous annular external shoulder 76 defined at the first end 62 of cartridge 60, about which a continuous annular O-ring 78, for example a neoprene O-ring, is passed for sealing the first end of the cartridge, and thus the gland seal assembly, on the base portion, i.e. in the gland seal receiving cavity defined within the second end 84 of the push rod housing 82, shown in FIG. 4. As with the first embodiment of gland seal assembly 25, a continuous annular counter-bore 79 is defined within the second end 63 of cartridge 60, again for preventing the flexure of the push rod from imparting an oscillating motion on either the cartridge 60, the gland seal assembly 50, or within the combined gland seal assembly and push rod housing, once joined together, as shown in FIG. 4.

The manner in which either one of gland seal assemblies 25 or 50 may be fit to a push rod housing is illustrated in FIG. 4. An elongate push rod housing 82 is disclosed having a first end 83 and a spaced second end 84, the push rod housing being formed concentrically about longitudinal axis A. A bore 86 is defined concentrically about the axis, and extends from the first end to the second end of the push rod housing. Received within bore 86 is a first tubular bushing 87, and positioned at the first end 83 of the push rod housing is a second tubular bushing 88, which is formed as a collar or sleeve for guiding the push rod (not illustrated) into and through bore 86. A continuous annular mounting flange 90 is formed at the second end 84 of the push rod housing, and has a radially spaced series of openings 91 defined therein, one of which is shown in FIG. 4, through which a fastener (not illustrated) may be passed for threadably fastening the push rod housing within a defined recess (not illustrated) formed within the bottom of a conventional tufting machine head (not illustrated).

Push rod housing 82 has a gland seal receiving cavity 92 defined in its second end 84, sized and shaped to receive either one of gland seal assemblies 25 or 50, as desired. A continuous annular internal shoulder 94 is defined adjacent the gland seal receiving cavity, and is sized and shaped to receive the continuous O-ring 45, 78, respectively, thereon, and between either one of external shoulders 43, 76 of the two embodiments of the gland seal assembly, respectively, for sealing the gland seal assembly on the push rod housing. Although not illustrated in FIG. 4, it is anticipated, if so desired, that a sealing gasket could be positioned about mounting flanges 30, 58, respectively, as well as at the first end of the carriers 26, 51, respectively, engaged with the second end of the push rod housing about bore 86 of the push rod housing, and about bore 33 of the gland seal assembly 25 illustrated in FIG. 4.

Either one of the two gland seal assemblies 25 or 50 will be positioned within the gland seal receiving cavity, and moved upwardly therein along axis A until such time, as shown in FIG. 4 for gland seal assembly 25, that the mounting flange of the gland seal assembly is engaged on the recessed surface defined within the second end of the push rod housing therefor. Thereafter, fasteners are passed through openings 31 and threaded into the push rod housing for threadably fastening the gland seal assembly, again either gland seal assembly 25 or 50, to the push rod housing. As this occurs, however, the O-ring 45, 78, respectively, situated atop shoulder 43 or shoulder 76 is compressed between shoulder 43, 76, respectively, and shoulder 94 for sealing the gland seal assembly on the push rod housing. Once this seal is made, the only potential point of oil leakage would be along the push rod itself as it passes through the gland seal assembly. However, due to the unique construction of the gland seal assemblies of this invention, namely the use of two closely spaced lip seals and wiper seals, respectively, which define a bearing surface at the second end of the respective gland seal assemblies, and thus at the second end of the push rod housing for supporting the push rod and preventing any push rod oscillation or bending, or movement of the gland seals 41 and 42, on 74 and 75, respectively, by the flexure of the push rod due to the nature of tufting machine operation, described above, a much more uniform and reliable seal is maintained. Through the use of the bearing surfaces 38, 39 of gland seal assembly 25, and bearing surfaces 71, 72 of gland seal assembly 50, the push rod is rigidly supported as it passes through the gland seal assembly, and any oscillation imparted to the push rod through the transverse movement of the needles in the backing material is thus greatly minimized, and thus the lip seals 41, 74, are allowed to perform their intended task, namely sealing the exterior periphery of the push rod such that oil does not hydroplane on the push rod thereunder as it does for the felt washer 17 and the push rod wiper seal 19 the known type of seal assembly 15 illustrated in FIG. 1.

Although not illustrated in FIG. 4, it is anticipated that if the embodiment of gland seal assembly 50 illustrated in FIGS. 2B and 3B is used, that the cartridge 60 will be selectively threaded into bore 55 of carrier 51, carrier 51 being capable of being attached to the push rod housing independently of cartridge 60, such that the amount O-ring 78 is compressed between shoulder 76 on the cartridge, and internal shoulder 94 of the push rod housing may be selectively determined. Moreover, based on the size of O-ring 78 as well as the physical length of cartridge 60, it may be possible that cartridge 60 need not extend as far into the second end of push rod housing 82 as would carrier 26 of gland seal assembly 25, such that the bearing surfaces 71, 72 of cartridge 60 could be positioned axially farther along axis A than are bearing surfaces 38, 39 of the gland seal assembly 25 illustrated in FIGS. 2A, 3A, and 4.

Carrier 51 of gland seal assembly 50 will preferably be machined out of a solid piece of bar stock, and may be steel as opposed to a brass or bronze bearing material, as the carrier 51 will not come into contact with the push rod passed through the gland seal assembly. Cartridge 60 is preferably machined from a piece of brass or bronze cartridge, and may comprise a fitting commercially available from the Parker Motion and Control Group, identified as the gland seal kits for hydraulic cylinders for series H, 2H, 7" and 8" bore 3H, VH, L, 2L, and 3L hydraulic cylinders. If a Parker motion control cartridge is used, however, it is anticipated that the cartridge will be machined to a desired length, based on the construction of push rod housing 82, and particularly with regard to the location of shoulder 76 along the length of the cartridge and the position of internal shoulder 94 defined within the push rod housing such that a complete and adequate seal is attained when the gland seal assembly 50, and particularly cartridge 60, is fastened to the second end 84 of push rod housing 82 within gland seal cavity 92.

Gland seal assembly 25 as shown in FIG. 2A, as well as the alternate embodiment of gland seal assembly 50 shown in FIG. 2B, can each be used with the known type of push rod housings, such as push rod housing 5 illustrated in FIG. 1. As such, the respective gland seal assemblies can be provided as retrofit assemblies used to replace the known types of push rod housing seal assemblies using felt washers, and which have proven to be unsatisfactory in preventing the leakage of oil therethrough during continued use, again due to the problems of push rod flexure and/or oscillation as described above.

Gland seal assemblies 25 and 50 allow, therefore, the producers of tufted articles to realize greater efficiencies using the known types of tufting machines by reducing the amount of spoilage or waste resulting from the spillage of oil from the head of the tufting machine onto the backing material of the tufted articles. Moreover, the amount of machine maintenance and service required has been greatly reduced in that these gland seal assemblies provide a much greater service life than the known seal assemblies described hereinabove, which greatly reduces the wear on the seals and also the amount of manpower, and thus labor costs, required to keep the tufting machine in proper operational order.

While preferred embodiments of the invention have been disclosed in the foregoing specification, it is understood by those skilled in the art that variations and modifications thereof can be made without departing from the spirit and scope of the invention, as set forth in the following claims. In addition, the corresponding structures, materials, acts, and equivalents of all means or step plus function elements in the claims are intended to include any structure, material, or act for performing the functions in combination with other claimed elements, as specifically claimed herein.

I claim:

1. A push rod housing and gland seal assembly in a tufting machine, the tufting machine having a push rod reciprocally driven through the push rod housing and gland seal assembly toward and away from a tufting zone, comprising:

a push rod housing having a first housing end and a spaced second housing end and defining an internal housing side wall; said internal housing side wall defining a housing bore for receiving the push rod; a gland seal assembly, said gland seal assembly comprising a carrier, said carrier having a first carrier end and a spaced second carrier end; said carrier including an internal carrier side wall defining a carrier bore therethrough and a carrier outer surface; said internal carrier side wall defining a first bearing surface; said carrier side wall also defining a second bearing surface spaced from said first bearing surface; a seal positioned between said first bearing surface and said second bearing surface; and a flange formed along said carrier outer surface adapted to mount said gland seal assembly to the second end of said push rod housing so that said housing bore and said carrier bore are in axial alignment, wherein said first bearing surface and said second bearing surface support said push rod as it reciprocates through said carrier bore, and prevent said push rod from bending at said second end of said push rod housing.

2. The push rod housing and gland seal assembly of claim 1, and a second seal positioned within said carrier bore adjacent to said second bearing surface.

3. The push rod housing and gland seal assembly of claims 2, wherein said seals are dynamic seals.

4. The push rod housing and gland seal assembly of claim 3, wherein said seals are selected from a group consisting of lip seals and wiper seals.

5. The push rod housing and gland seal assembly of claims 4, wherein said first seal is a lip seal and said second seal is a wiper seal.

6. The push rod housing and gland seal assembly of claim 1, wherein said first end defines a shoulder, and a third seal positioned adjacent to said shoulder.

7. The push rod housing and gland seal assembly of claim 6, wherein said third seal comprises an O-ring.

8. The push rod housing and gland seal assembly of claim 1, and a counterbore defined by said carrier side wall adjacent to said second end.

9. A push rod housing and gland seal assembly in a tufting machine, the tufting machine having a push rod reciprocally driven through the push rod housing and gland seal assembly toward and away from a tufting zone, comprising:

a push rod housing having a first housing end and a spaced second housing end and defining an internal housing side wall; said internal housing side wall defining a housing bore for receiving the push rod; a gland seal assembly, said gland seal assembly comprising a carrier, said carrier having a first carrier end and a spaced second carrier end; said carrier including an internal carrier side wall defining a carrier bore therethrough and a carrier outer surface; said carrier side wall also defining internal first threads; a cartridge; said cartridge having a first cartridge end and a second cartridge end and a cartridge outer surface; said cartridge defining second threads along the cartridge outer surface for mating with the internal threads of said carrier; said cartridge including an internal cartridge side wall defining a cartridge bore therethrough; said internal cartridge side wall defining a first bearing surface; said internal cartridge side wall also defining a second bearing surface spaced from said first bearing surface; a seal positioned between said first bearing surface and said second bearing surface; and a flange formed along said carrier outer surface adapted to mount said gland seal assembly to the second end of said push rod housing so that said housing bore and said carrier bore are in axial alignment, wherein said first bearing surface and said second bearing surface support said push rod as it reciprocates through said cartridge bore, and prevent said push rod from bending at said second end of said push rod housing.

10. The push rod housing and gland seal assembly of claim 9, and a second seal positioned within said carrier bore adjacent to said second bearing surface.

11. The push rod housing and gland seal assembly of claim 10, wherein said seals are dynamic seals.

12. The push rod housing and gland seal assembly of claim 11, wherein said seals are selected from a group consisting of lip seals and wiper seals.

13. The push rod housing and gland seal assembly of claim 12, wherein said first seal is a lip seal and said second seal is a wiper seal.

14. The push rod housing and gland seal assembly of claims 9, wherein said first carrier end defines a shoulder, and a third seal positioned adjacent to said shoulder.

15. The push rod housing and gland seal assembly of claims 14, wherein said third seal comprises an O-ring.

16. The push rod housing and gland seal assembly of claim 9, and a counterbore defined by said cartridge side wall adjacent to said second end.

* * * * *